US006112631A

United States Patent [19]

VanAlstine

[11] Patent Number: 6,112,631

[45] Date of Patent: Sep. 5, 2000

[54] MECHANISM FOR PAPER DISPENSER

[76] Inventor: Terrance L. VanAlstine, 133 W. Skyline Dr., Palatine Bridge, N.Y. 13428

[21] Appl. No.: 08/852,745

[22] Filed: May 7, 1997

[51] Int. Cl.[7] ..... A47K 10/36; B26D 5/24; B65H 35/06

[52] U.S. Cl. ..... 83/589; 83/339; 83/602; 83/649; 225/15; 242/564.1

[58] Field of Search ..... 83/589, 588, 334, 83/335, 337, 339, 349, 649, 650, 524, 601, 602, 660; 225/10, 11, 12, 13, 14, 15, 16, 72, 90; 242/564.1, 564.4, 565

[56] References Cited

U.S. PATENT DOCUMENTS

| | | | |
|---|---|---|---|
| 575,568 | 1/1897 | Haviland | 225/14 |
| 998,561 | 7/1911 | Willis | 83/387 |
| 2,121,346 | 6/1938 | Harvey | 225/14 |
| 2,139,339 | 12/1938 | Vaughan et al. | 225/16 |
| 2,457,439 | 12/1948 | Birr | 242/565 |
| 2,649,655 | 8/1953 | Flaws, Jr. | 83/589 X |
| 3,248,983 | 5/1966 | St. Denny et al. | 83/589 X |
| 3,507,428 | 4/1970 | Leibreich | 225/11 |
| 3,734,586 | 5/1973 | Schnyder | 242/565 |
| 3,896,691 | 7/1975 | Granger et al. | 83/335 |
| 4,122,738 | 10/1978 | Granger | 83/337 X |
| 4,189,077 | 2/1980 | Hartbauer et al. | 225/14 |
| 4,441,392 | 4/1984 | DeLuca | 83/337 |
| 4,635,837 | 1/1987 | Granger | 83/337 X |
| 4,712,461 | 12/1987 | Rasmussen | 83/334 |
| 5,048,386 | 9/1991 | DeLuca et al. | 83/37 |
| 5,078,033 | 1/1992 | Formon | 83/335 |
| 5,135,147 | 8/1992 | Granger | 225/96 |
| 5,161,723 | 11/1992 | Wirtz-Odenthal | 225/14 |
| 5,257,711 | 11/1993 | Wirtz-Odenthal | 225/14 |
| 5,441,189 | 8/1995 | Formon et al. | 225/2 |

*Primary Examiner*—Clark F. Dexter
*Attorney, Agent, or Firm*—Wall Marjama Bilinski & Burr

[57] ABSTRACT

A towel dispensing mechanism includes a frame upon which a quantity of paper is stored on a supply reel. An extending portion of paper pulled through an exit slot of the housing rotates a paper feed roller rotatably supported within the frame, causing an attached arm member to engage a knife assembly, and causing a pivoting cutting blade to move into engagement with the paper web after the roller has rotated to a predetermined position. The knife assembly is biased to allow restoration to a precutting position when the arm member no longer engages the knife assembly. According to a preferable arrangement, a vertically disposed intermediately disposed engagement element supported to the frame interconnects the arm member with the knife assembly. Biasing of the arm member causes the feed roller to rotate additionally a predetermined amount after the paper has been cut, thereby metering a predetermined amount of paper from the supply reel through the exit slot.

11 Claims, 7 Drawing Sheets

MECHANISM FOR PAPER DISPENSER

FIELD OF THE INVENTION

The invention relates to the field of dispensing mechanisms, and more particularly to a mechanism for use in a paper towel dispenser which allows a predetermined towel length to be automatically dispensed when a user pulls on an extending section of towel.

BACKGROUND OF THE INVENTION

There are known dispensers, such as found in washrooms, rest stops, and the like which meter a length of paper towel from a supply roll contained in a housing having an external lever. Actuation of the lever by a user causes paper to be pulled from the supply roll where it is metered through an exit slot found in the bottom of the dispenser housing. The user pulls the extending portion of paper, enabling the paper to be cut by an adjacent knife assembly. Overuse of the lever prior to cutting sometimes causes paper to bunch up in the bottom of the housing.

Similarly, there are other known dispensers which allow a predetermined length of paper towel to be removed from the bottom of a vertically stored stack of folded pre-cut paper towels through a slot in the bottom housing. Problems with this type of machine include removing too many sheets of the paper towel at one time, insufficient surface area of towel in a single sheet, and the associated costs of the manufacturer to provide folded sheets, as opposed to providing a supply roll, the common and simplest form of paper manufacture.

A need developed to provide a paper towel dispenser which automatically dispensed sheets from a housed supply roll by the user. Such mechanisms are described in U.S. Pat. No. 5,441,189, issued to Formon et al, U.S. Pat. No. 5,078,033, issued to Formon, and U.S. Pat. Nos. 5,161,723, and 5,257,711, each issued to Wirtz-Odenthal, among others. Each of the dispensers, however, involve relatively complex mechanisms, having several intricate subassemblies and an inordinate number of parts, making manufacture difficult and expensive. In addition, these mechanisms are not mass-producible, especially processes using lightweight plastic-molded materials.

SUMMARY OF THE INVENTION

It is a primary object of the present invention to provide a paper towel dispenser which allows automatic dispensing of a predetermined length of paper towel and which overcomes the problems associated with dispensers found in the prior art.

It is a further object of the present invention to provide a paper towel dispenser which automatically meters a predetermined amount of paper when an extending amount is pulled by a user.

Therefore, and according to a preferred aspect of the present invention, there is provided apparatus for dispensing a predetermined length of paper from a supply roll, said apparatus comprising:

a frame disposed in proximity to said supply roll;

a first roller rotatably supported by said frame;

a second roller in engagement with said first roller through which paper from said supply roll is initially threaded, said frame including means for defining a paper travel path including an exit through which said paper can be pulled from said supply roll;

a knife assembly attached to said frame, said knife assembly including at least one movable cutting blade disposed adjacent said frame exit;

an arm member attached to one end of said first roller, said arm member element being rotatable with said first roller;

means for biasing said arm member and said first roller in an initial position; and an intermediate engagement element attached to said frame and disposed between said arm member and said knife assembly, wherein pulling said paper from said exit causes said arm member to rotate into contact with said engagement element, thereby moving said engagement element into contact with said knife assembly and causing said at least one cutting blade to be moved into said paper travel path to cut said paper after a predetermined length has been pulled, said biasing means causing said first roller to rotate to said initial position, thereby metering an additional length of paper through said exit after the paper has been cut.

According to a preferred embodiment, the apparatus includes tensioning means to compensate for the variation in supply roll size as paper is withdrawn. Still, more preferably, the tensioning means includes a linkage having at least one engagement element biased into contact with the first roller.

The first roller is a feed or measuring roller having a circumference which corresponds to the predetermined length of paper to be dispensed.

The knife assembly, according to a preferred embodiment, includes a pivotally mounted lever rotatably supported by the frame. The lever includes at least one cutting blade which is reciprocated into and out of the paper path, the lever having an extending pin disposed at one end of the cutting blade portion of the pivotal lever.

The pin extends into a circumferential slot in the frame and is engaged by the engagement element when the arm member has been rotated by the feed roller into a predetermined location; i.e., when a specific amount of paper has been pulled by the user of the apparatus.

The circumferential slot defines the length of travel of the pivotal lever of the knife assembly, the lever being biased to the frame such that the lever places the cutting blade in a retracted position until the pin is engaged by rotation of the arm member and corresponding movement of the engagement element, moving the pin to the end of the circumferential slot and the cutting blades into engagement with the paper.

The engagement element preferably includes a slidable member having engaging or bearing surfaces sized to contact the arm member and the extending pin of the pivoting knife lever.

The apparatus includes a number of rollers supported for rotation by the frame, including a pinch roller for engaging the feed or measuring roller forming a nip roller set as well as paper guides for guiding the paper through the mechanism to an exit slot.

In summary, the above mechanism/apparatus provides a reliable and simple means for dispensing a predetermined length of paper automatically by pulling an extending length of paper, and is useful such as in sanitary paper towel dispensers or other mechanisms using webs of thin, flexible material.

Preferably, the first roller includes an anti-backup mechanism to prevent the roller from rotation other than in the paper dispensing direction.

According to another preferred aspect of the present invention, there is described a paper towel dispenser capable of automatically dispensing a predetermined length of paper from a contained supply roll, said dispenser comprising:

a frame disposed in proximity to said supply roll;

a first roller rotatably supported by said frame;

a second roller in engagement with said first roller through which paper from said supply roll is initially threaded, said frame including means for defining a paper travel path including an exit through which said paper can be pulled from said supply roll;

a knife assembly attached to said frame, said knife assembly including at least one movable cutting blade disposed adjacent said frame exit;

an arm member attached to one end of said first roller, said arm member element being rotatable with said first roller;

means for biasing said arm member and said first roller in an initial position; and an engagement element attached to said frame and disposed between said arm member and said knife assembly, wherein pulling said paper from said exit causes said arm member to rotate into contact with said engagement element, thereby moving said engagement element into contact with said knife assembly and causing said at least one cutting blade to be moved into said paper travel path to cut said paper after a predetermined length has been pulled, said biasing means causing said first roller to rotate to said initial position, thereby metering an additional length of paper through said exit after the paper has been cut.

An advantage of the present invention is that the described mechanism is capable of reliably and automatically dispensing a predetermined amount of towel.

Another advantage of the present invention is the mechanism is simple, reliable, and can be easily manufactured, such as for mass production, requiring fewer moving parts than prior dispensers of this type.

In addition, the simplicity and novelty of the concepts employed in the mechanism allows adaptability to cover nearly any size of supply roll and form of dispenser.

These and other objects, aspects, features, and advantages are herein illustrated in the accompanying drawings when read in accordance with the following Detailed Description of the Invention.

BRIEF DESCRIPTION OF THE DRAWINGS

FIGS. 5(*a*), 6(*a*), and 7(*a*) are sectional views of the paper towel dispenser as taken through lines 5*a*—5*a*, 6*a*—6*a*, and 7*a*—7*a*, respectively

DETAILED DESCRIPTION OF THE INVENTION

The following description relates to a specific sanitary paper towel dispenser and dispensing mechanism according to a preferred embodiment of the present invention. Throughout the course of discussion, terms such as "top", "bottom", "side", "upper", "lower", "outward"and "inward" are used to provide a frame of reference for the accompanying drawings. These terms are not, however, intended to limit the inventive concepts described herein. Moreover, it will be apparent that the described apparatus can be employed in other web-handling apparatus involving thin flexible materials.

Figure 1:
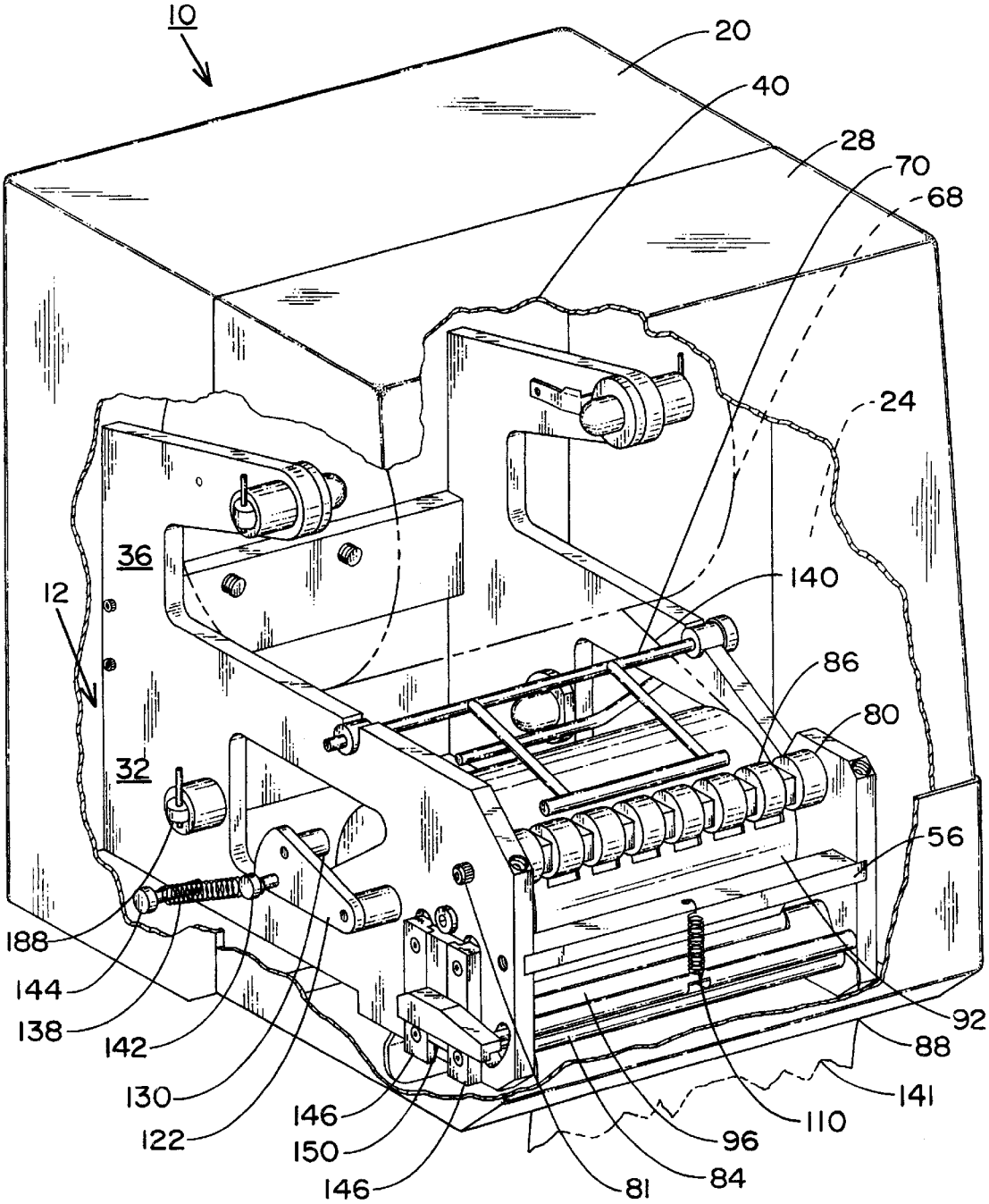
FIG. 1 is front perspective view of a sanitary paper towel dispenser, partially cutaway, having a contained dispensing mechanism according to a preferred embodiment of the present invention.

Referring to the FIGS. and specifically to FIG. 1, there is shown a paper towel dispenser 10 according to the specific embodiment having a housing 20, including a defined interior 24, and a door or front cover 28 which is pivotally attached to the bottom of the housing. Preferably, the housing 20 is made from steel, aluminum or other suitable material and includes a number of openings (not shown) in the rear thereof to allow mounting to a wall or other planar surface. The door 28 is made from a partially transparent plastic material, such as a polycarbonate and can be opened to access the interior 24 of the housing 20 using a locking mechanism (not shown) provided at the top of the housing 20. Housings and doors as described are commonly known in the field, such as those manufactured by Fort Howard, Inc, among others. Details relating to the mounting of the door 28, the door locking mechanism, and the structure of the housing 20, being commonly known to those in the field do not form an essential part of the present invention. Therefore, no further details cr discussion is required except as necessary.

Figure 2:
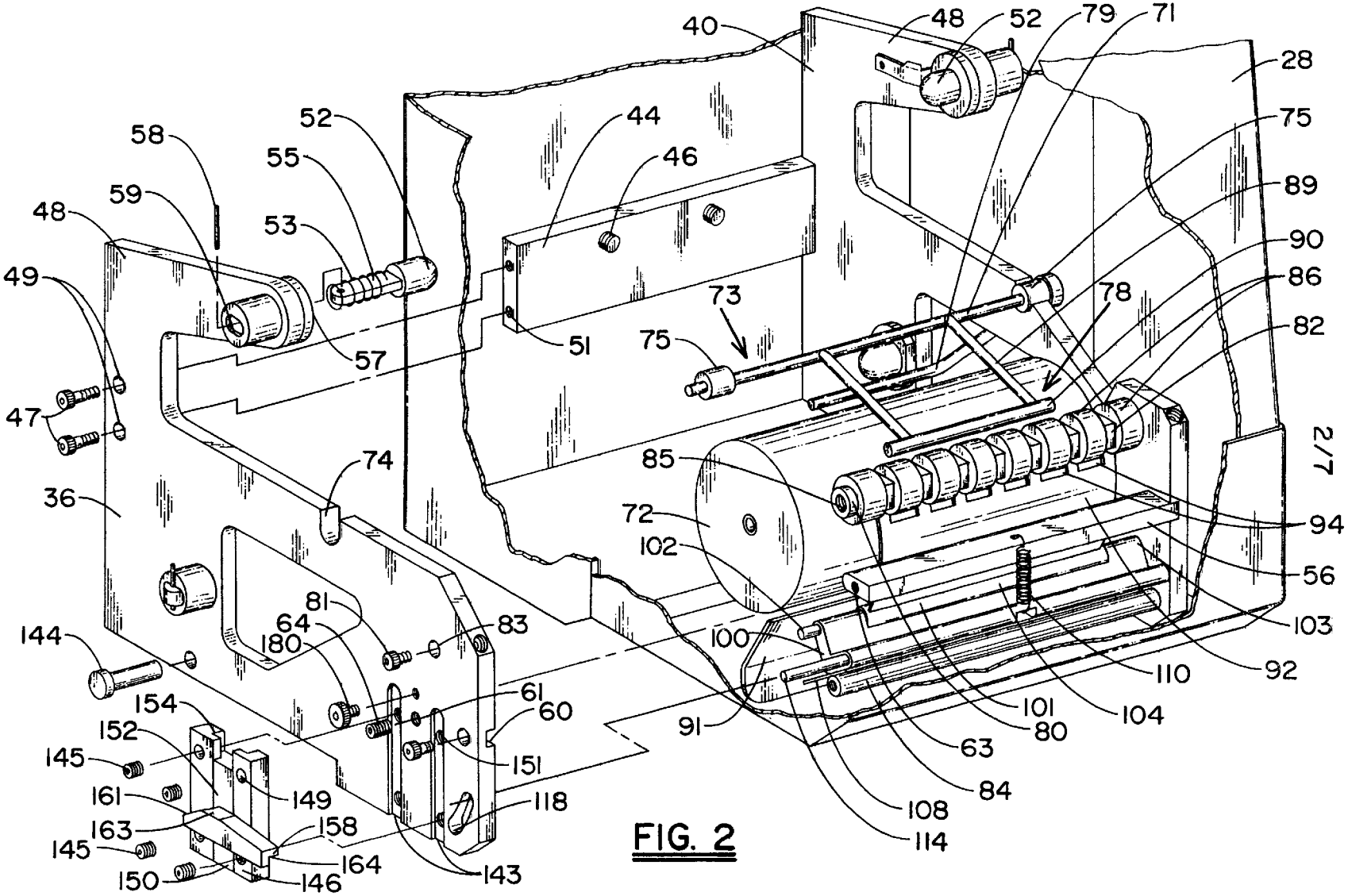
FIG. 2 is a partial cutaway view of the paper towel dispenser of FIG. 1, including a partially exploded view of the contained dispensing mechanism.

Referring to FIG. 2, a support frame 32 retaining the essential elements of a dispensing mechanism 12 is mounted within the defined interior 24 of the housing 20. The frame 32, according to this embodiment, includes a pair of lateral or side supporting plates 36, 40 interconnected by a back supporting plate 44. The back supporting plate 44 includes a pair of fasteners 46, allowing the frame 32 to be mounted to the housing 20 through openings (not shown) in the rear wall of the housing. Additionally, a pair of fasteners 47 secure each end of the back supporting plate 44 through openings 49, 51 to each of the lateral supporting plates 36, 40.

According to this embodiment, and still referring to FIG. 2, each of the lateral supporting plates 36, 40 include respective upper arm portions 48, each portion having an inwardly projecting axial roll retaining tab 52. The support tabs 52 are sized to engage and retain the diameter of a paper supply roll 68, shown in phantom in FIG. 1, and include a plunger-like element having a biasing spring 53 attached to a tab shaft 55 which is pinned, using vertically oriented pin member 58, at one end of a retaining cavity 57 through an opening 59. The lateral supporting plates 36, 40 and the axial roll retaining tabs 52 are spaced to allow a paper supply roll 68, FIG. 1, of a predetermined size to be rotatably supported. Alternately, the paper supply roll 68 call be otherwise disposed within the housing 20 separately from the frame 32 for guiding paper to the dispensing mechanism 12, as is described in greater detail below.

Referring to FIGS. 1 and 2, the frame 32 is also interconnected by a front supporting plate 56 disposed at either end within a recessed slot 60 provided on the interior of each lateral supporting plate 36, 40. The front supporting plate 56 is securably attached thereto using threaded fasteners 64 attached through respective openings 61, 63.

A feed or measuring roller 72, made from a glossy rubber, phenolic or other material, is disposed directly beneath and in front of the paper supply roll 68. The feed roller 72 is rotatably supported within the frame 32 by means of a supporting shaft 76, shown most clearly in FIG. 4, passing through the center of the roller and each of the lateral supporting plates 36, 40. The roller 72 has a diameter and circumference which dictates the predetermined length of towel dispensed, as will be apparent from the discussion which follows.

The dispensing mechanism 12 also includes a pinch roller 80 located above and in front of the feed roller 72. The pinch roller 80 consists of a plastic roller shaft 82 rotatably supported to the frame 32 by engagement of a threaded fastener 81 within a corresponding threaded opening 85 provided at each end of the roller shaft. An access opening 83 is provided for the threaded fastener 81 through each of the lateral supporting plates 36, 40, only the interconnection with lateral plate 36 is shown in the partially exploded FIG. 2. A plurality of rubberized roller sections 86, evenly spaced along the length of the roller shaft 82, bear directly upon the exterior surface of the feed roller 72, thereby forming a pair of nips for paper supplied from the supply (parent) roll 68, as is detailed more completely below.

Figure 3:
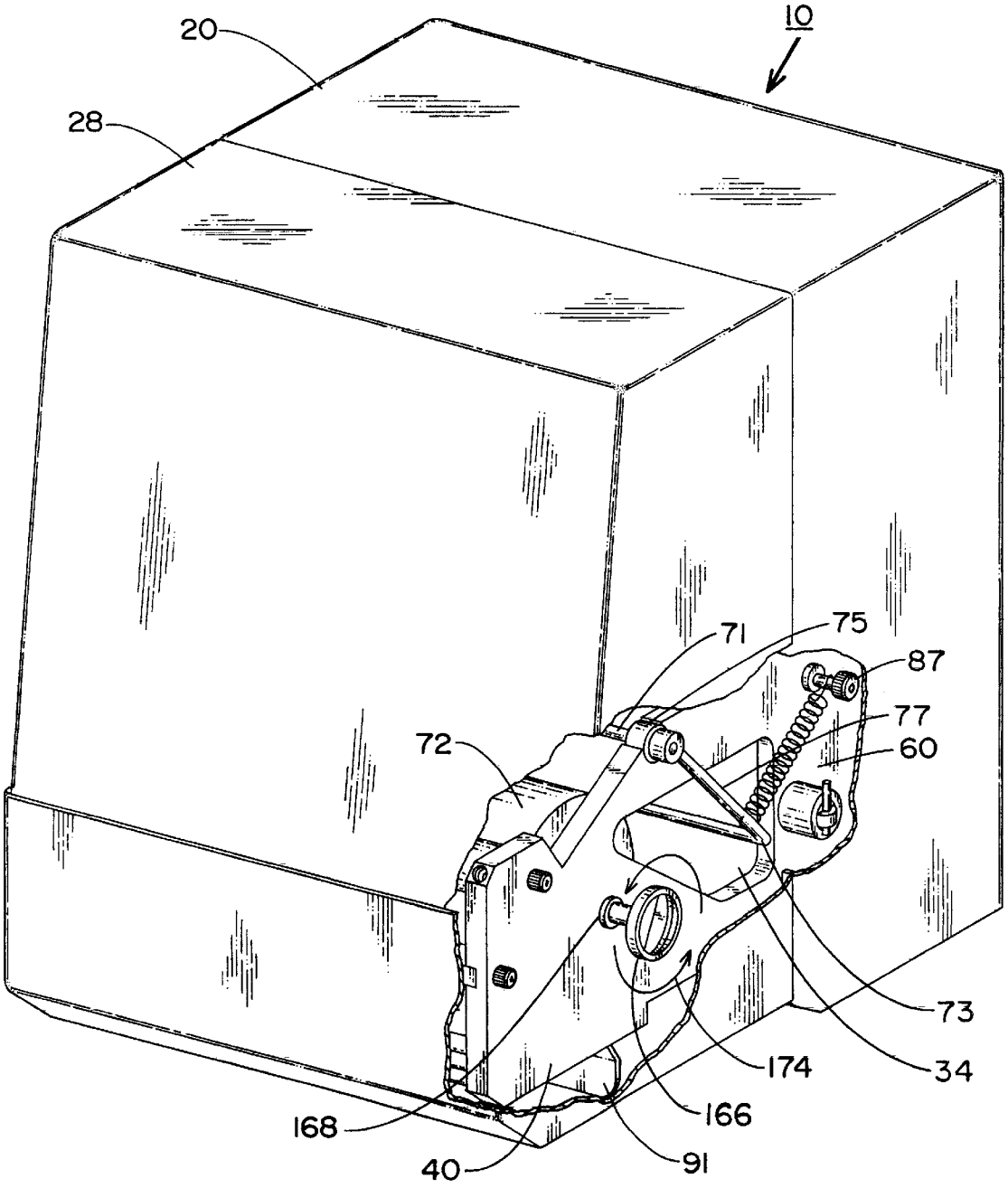
FIG. 3 is a front perspective view of the paper towel dispenser of FIGS. 1 and 2, as rotated 90 degrees therefrom, which is partially cutaway to illustrate other relevant portions of the dispensing mechanism.

Referring to FIGS. 1–3, a paper tensioning member 70 is intermediately disposed between the paper supply roll 68 and the nip of the rollers 72, 80. The tensioning member 70 includes a rod-like linkage 73 having a supported section 71 extending between the lateral supporting plates 36, 40 which is pivotally supported through sleeves 75 fixedly positioned within respective slots 74. The linkage 73 further includes a leg portion 77 extending downwardly from the supported portion 71 along the exterior of the lateral supporting plate 40, and a base portion 79 passing through a slot 34 in the frame 32 behind and beneath the feed roller 72. One end of a tensioning spring 69 is fixedly attached by known means to the leg portion 77, the other end of the spring being fixedly affixed to the side supporting plate 40 using a threaded fastener 87. As described in greater detail below, the tensioning spring 69 biases the supported section 71, and more significantly, an extending tensioning portion 78 into contact with the feed roller 72. The tensioning portion 78, according to this embodiment, includes a parallel set of rod-like members 89 extending from the supported section 71 having a connecting end member 90, which when biased is nominally positioned adjacent the pinch roller 80 and in direct contact with the feed roller 72, as shown in FIG. 1. The contact of the tensioning portion 78 does not affect the ability of either the feed roller 72 or the pinch roller 80 to rotate.

Referring to FIGS. 1 and 2, the dispensing mechanism 12 further includes a knife assembly 96 comprising a L-shaped lever 100 disposed between the two lateral supporting plates 36, 40 and located directly beneath the front supporting plate 56 and a paper guide 92. The paper guide 92 is a sheet section having a concave curvature approximating that of the feed roller 72 which is welded or otherwise attached to the rear side of the front supporting plate 56. A series of spaced slots 94 allows passage of the rubberized roller sections 86 of the pinch roller 80 at an upper end of the paper guide 92.

Referring back to the knife assembly 96, the L-shaped lever 100 includes an upper portion 103 rotatably supported onto a cylindrical shaft 102 extending across the front of the frame 32 and fitted into respective openings (not shown) of the lateral supporting plates 36, 40. The upper portion 103 preferably includes a recessed portion 101 for accommodating a freely rotatable plastic roller 104 disposed over the cylindrical shaft 102 and having a length which coincides with that of the paper guide 92. As more clearly shown in FIG. 4, a light-gauge, metal cutting blade 108, having a series of serrated cutting teeth 112, is attached to the bottom of the L-shaped lever 100 using threaded fasteners, or other suitable means. Though not shown, the cutting teeth could alternately be integrally molded to the bottom of the lever. According to this embodiment, and still referring to FIG. 4, the cutting blade 108 includes five (5) spaced teeth disposed on either side of a center recess 106.

Referring back to FIGS. 1 and 2, the lever 100 is pivotally biased to the front supporting plate 56 by means of a center biasing spring 110. In the biased position, the cutting teeth 112 are pivoted outwardly and retracted away from the interior of the frame 32, and more specifically away from the defined paper travel path. A pin 114 having a cylindrical cross section extends from the end of the bottom of the lever 100 through an arcuate slot 118 in the side supporting plate 36 of the frame 32. In the first or retracted position, shown in FIG. 5, the pin 114 is in the upward-most end of the arcuate slot 118, the length of the slot defining the overall length of pivotal travel of the lever 100.

A guide roller 84 made from plastic or other suitable material is similarly disposed between the lateral supporting plates 36, 40 at the bottom of the front of the frame 32 beneath the knife assembly 96. The guide roller 84 is rotatably supported onto a cylindrical shaft (not shown) having ends passing through openings (not shown) in each of the lateral supporting plates 36, 40. When the mechanism 12 is attached within the dispenser interior 24, the guide roller 84 is positioned adjacent an exit slot 88 provided at the bottom of the housing 20, the housing also preferably including an exit paper guide 91. The exit paper guide 91 is mounted to the housing 20 by known means and is configured to deflect the dispensed paper away from the feed roller 72 and toward the user.

Figure 4:
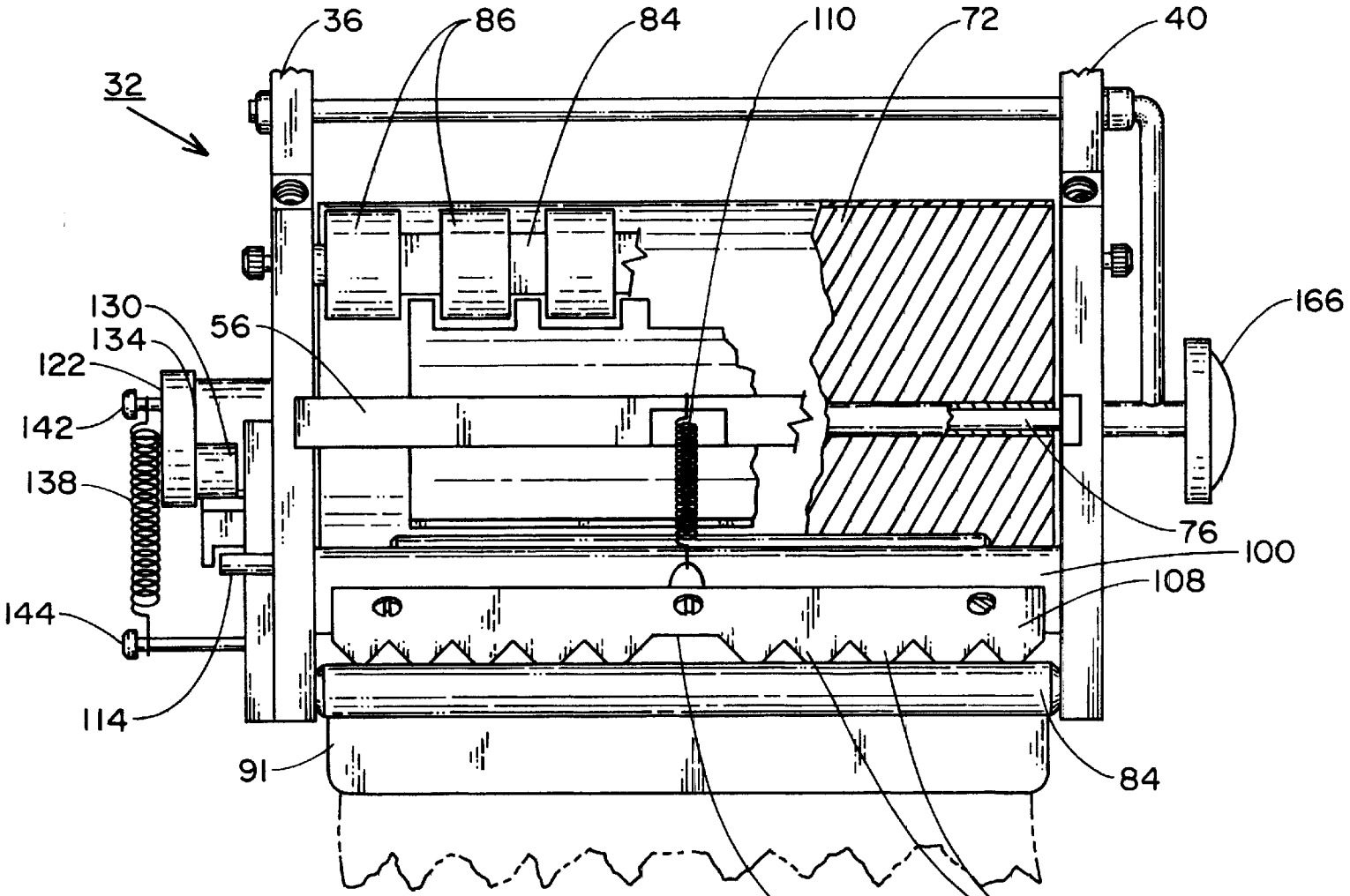
FIG. 4 is a partial front view, partially in section, of the dispensing mechanism of FIGS. 1–3.

Referring to FIGS. 1 and 4, and fixedly mounted over one end of the feed roller support shaft 76, exterior of the lateral supporting plate 36, is a cam throw arm 122 preferably engaged thereto by means of a set screw (not shown). The cam throw arm 122 has a radially projecting circular sector-like configuration and includes a cylindrical contacting portion 130 extending from a surface 134, facing inwardly toward the frame 32. The cylindrical contacting portion 130 is disposed on an outer radial portion of the sector; that is in a position which is disposed from the axis of the roller support shaft 76. The cam throw arm 122 is mounted relative to the lateral supporting plate 36 to allow rotational movement of the cam throw arm and cylindrical contacting portion 130 without interference in response to rotation of the feed roller 72.

A tensioning spring 138 is fixed at respective ends to the lateral supporting plate 36 and the cam throw arm 122, such as using attached threaded fasteners 142, 144. Preferably, the fastener 142 is mounted to the cam throw arm 122 on an outer radial portion of the defined sector. The tensioning spring 138 is configured so as to bias the cam throw arm 122, and connectively the feed roller 72 in an initial position, shown in FIGS. 1 and 5. Movement of the feed roller 72 in a paper unwinding direction, clockwise according to this embodiment, causes the cam throw arm 122 to rotate about the center axis of the roller 72 along a circular path against the biasing of the spring 138 in any rotational position except the initial position.

Referring to FIG. 2, a pair of rectangular supports 146 are fixedly mounted within corresponding recessed portions 143 provided on the exterior of the lateral supporting plate 36 using a plurality of set screws 145 attached through respective openings 149, 151. The supports 146, as mounted, define a spacing therebetween sized to accommodate a cam follower 150, a portion of the interior side of each support preferably being recessed to form a pair of dovetail rails 154, allowing sliding engagement of the cam follower in a vertical direction.

As most clearly detailed in FIGS. 1 and 2, the cam follower 150 includes a base section 152 having a T-shaped cross section and an outwardly extending engagement portion 158. The T-shaped base section 152 is configured to fit within the dovetail rails 154 provided between the two supports 146. The engagement portion 158 projects outwardly from the T-shaped base section 152 and includes a major dimension which is substantially perpendicular to the major dimensions of the supports 146 and the base section.

The engagement portion 158 of the cam follower 150 includes an upper bearing surface 160, defined by a tapered portion 161 and an adjacent horizontal surface portion 163, as well as a lower contacting surface 164. Initially, the lower contacting surface 164 is in engagement with the cylindrical surface of the pin 114 projecting through the circumferential slot 118. As will become apparent, the described cam follower 150 interconnects the feed roller 72 and the knife assembly 96.

Finally, and referring to FIG. 3, a manual advance knob 166 is fixedly attached to the remaining end of the feed roller support shaft 76. A one-way clutch bushing 168, partially shown in the FIG. 3, is inserted into an opening in the lateral supporting plate 40 and includes an opening through which the feed roller support shaft 76 extends. The one-way clutch bushing 168 contains rollers or other elements (not shown) which prevent the feed roller 72 from rotating other than in a paper unwinding (clockwise as perceived from the lateral supporting plate 36 side of the mechanism 12, or counterclockwise as perceived from the lateral supporting plate 40 side) direction. A bushing as described is known in the field, such as those of the RC series sold by the Torrington Company.

The initialization of the above assembly is now described with reference to FIGS. 1–3, in which the dispenser 10 receives a supply or parent roll 68 of paper towel material 140 supported for rotation within the axial roll retaining tabs 52 in the upper portion of the frame 32. As noted, the frame 32 is appropriately sized to retain the supply roll 68 between the lateral supporting plates 36, 40. In loading or initializing the dispensing mechanism 12, a leading end 141 of the paper material 140 from the supply roll 68 is fed down onto the feed roller 72 and under the biased tensioning portion 78 of the linkage 73 by pulling the leading end upwardly and feeding the paper therethrough.

To complete the initial charging of the dispenser 10, the manual advance knob 166 is rotated in a counterclockwise direction approximately ½ turn, as shown in the direction 174. Preferably, the door 28 includes an opening (not shown) to allow accessing of the knob 166 by an installer without having to open the dispenser 10. The advance knob 166, being attached to the end of the feed roller shaft 76, causes the feed roller 72 to rotate in a paper dispensing direction (clockwise, as perceived from the lateral supporting plate 36 side of the mechanism 12), and counter rotates the meshed pinch roller 80, thereby forcing the leading end 141 of the paper 140 between the nips of the rollers. The paper 140 is then caused to pass through the mechanism 12 along a paper travel path, defined between the feed roller 72 on one (rear) side, and the paper guide 92, the paper roller 104 and the guide roller 84, respectively, on the other (front) side. When the manual advance knob 166 has been turned approximately one-half turn, the tension return spring 138 biases the cam throw arm 122 back to its original position, causing the leading end 141 of the paper 140 to exit the mechanism 12 and the housing 20 through the exit slot 88, passing between the exit paper guide 91 and the guide roller 84. In doing so, the dispenser 10 is ready to be operated by a user and dispense according to the following sequence. The dispenser 10 and mechanism 12 are shown in the above described initialized state as shown in FIG. 1.

Preferably, anti-rotation of the feed roller support shaft 76 is prevented by the one-way bushing 168, having rollers (not shown) acting as an over running clutch, serving as an anti-rotation or anti-backup device allowing the feed roller 72 to only rotate in the paper dispensing direction.

Figures 5, 5A:
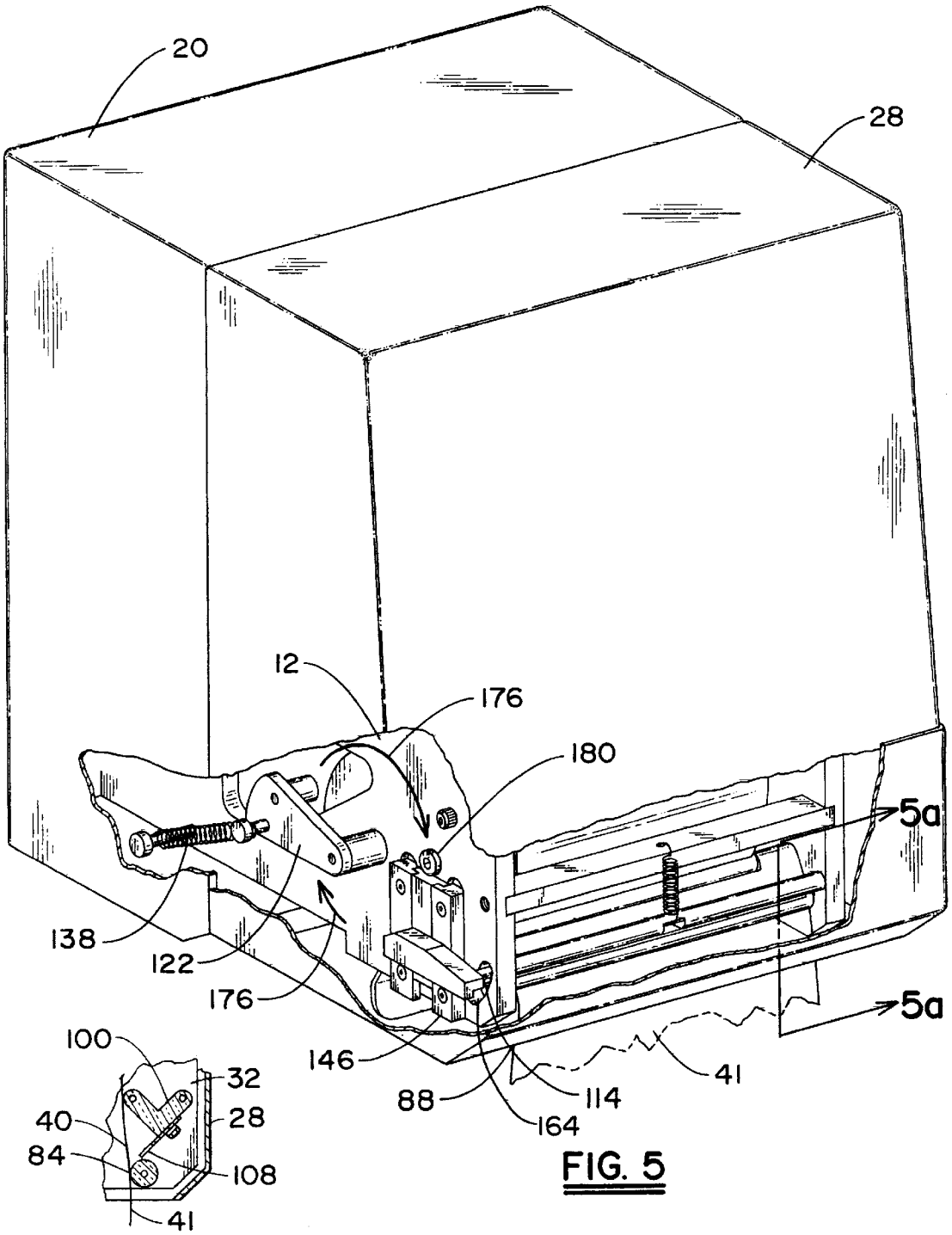
FIGS. 5, 6 and 7 are partially cutaway front perspective views of the paper towel dispenser of the preceding FIGS., illustrating the operational sequence of the dispensing mechanism.
Figures 6, 6A:
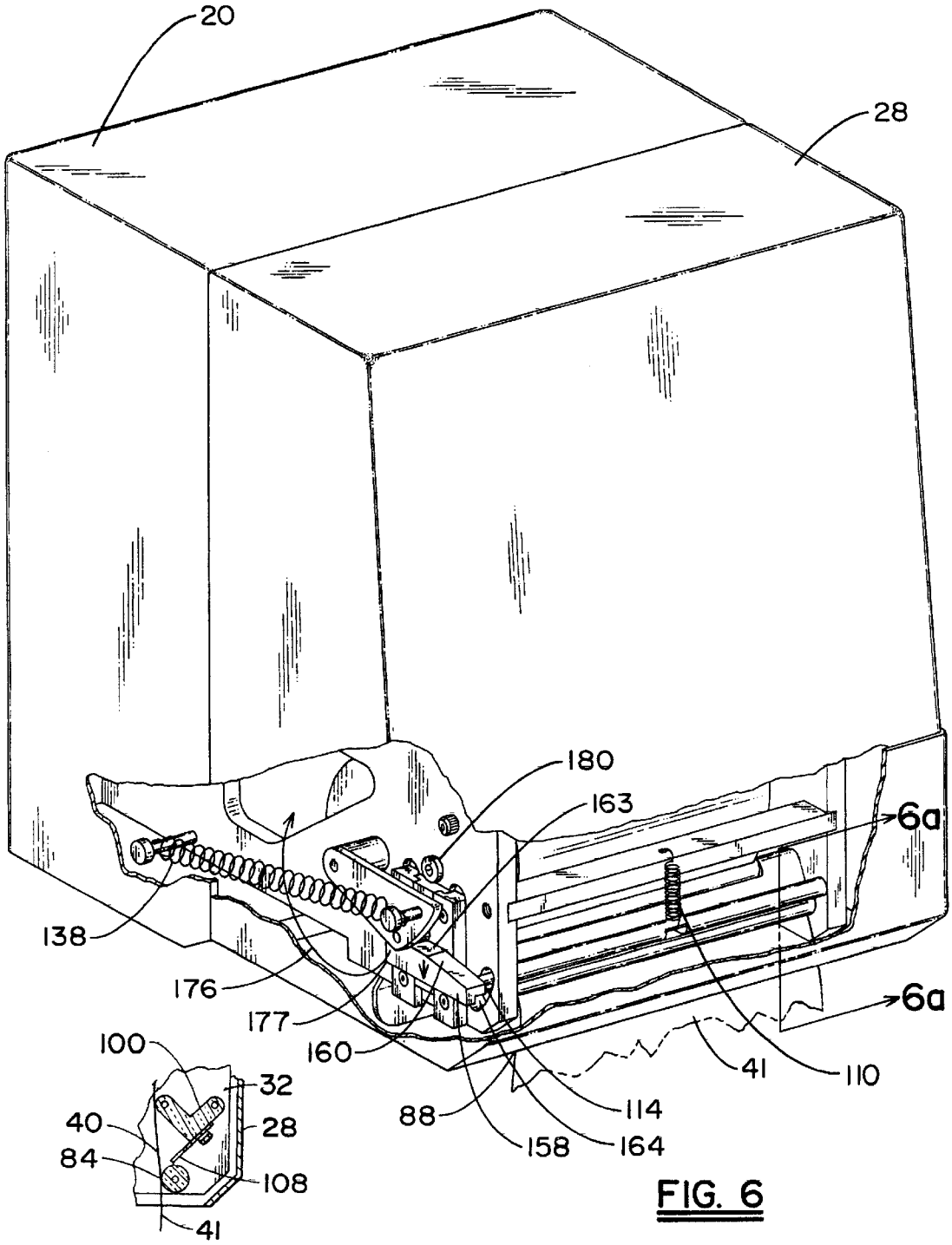
Figures 7, 7A:
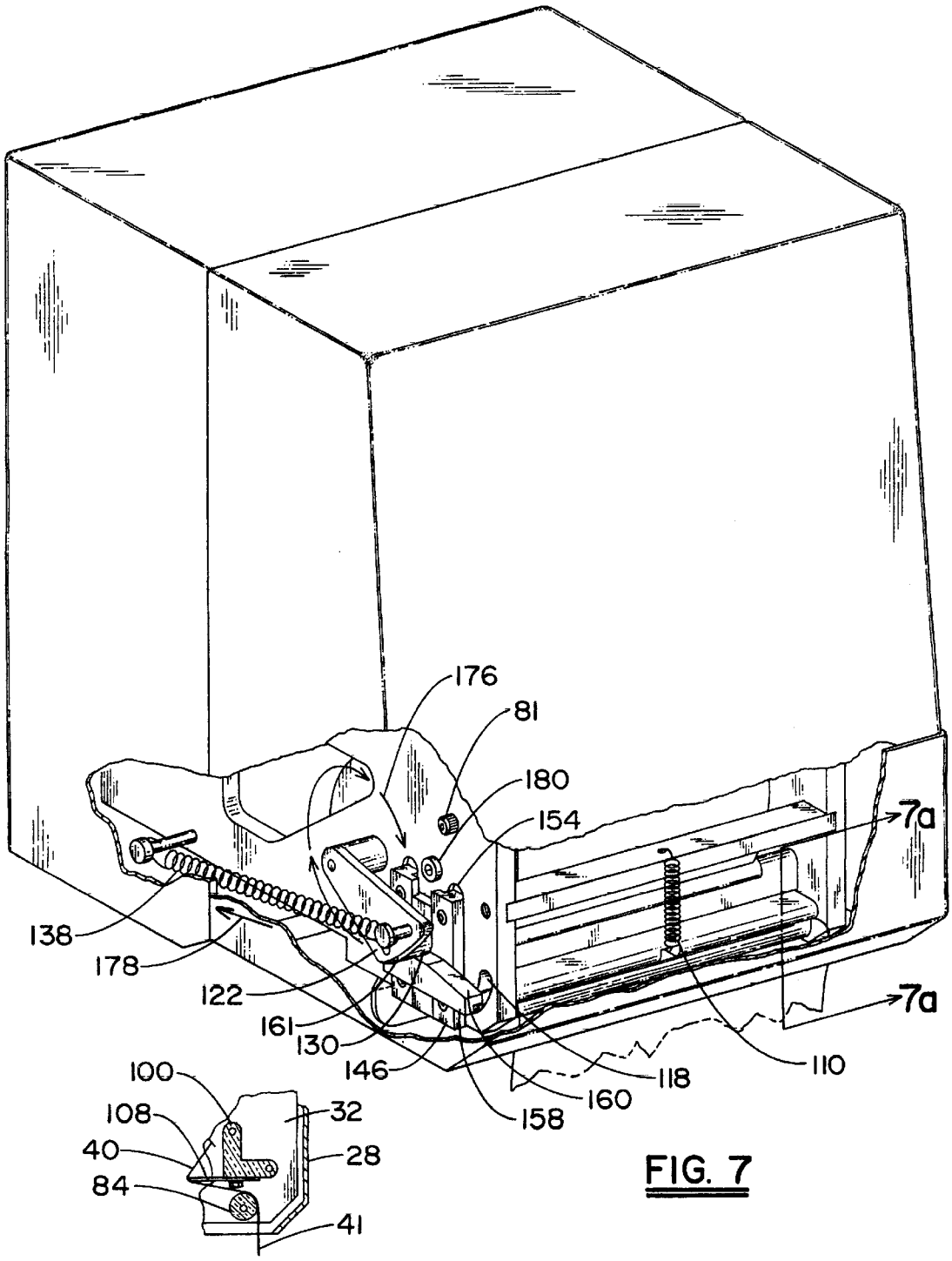

With reference to FIGS. 5–7, and after the initial charging, described above, the mechanism 12 is as shown according to FIG. 5, in which the leading end 141 of paper towel 140 is exposed below the mechanism 12 and extending through the exit slot 88 of the housing 20. The user (not shown) then pulls on the leading end 141, and in doing so, causes the feed roller 72, FIG. 1 to make an approximate one-half (180 degree) revolution, shown as direction 176, due to the user's effort. The applied force stretches the attached biasing spring 138 to its full extension and causes the cam throw arm 122 to correspondingly rotate with the feed roller 72 to the position shown in FIG. 6. In this specific position, the cylindrical contacting portion 130 on the cam throw arm 122 engages and bears upon the horizontal portion 163 of the upper bearing surface 160 of the engagement portion 158 of the cam follower 150. Continued rotation of the feed roller 72 causes the cam follower 150 to be forced downwardly, direction 177, along the rails 154 between the supports 146 by the engaging cam throw arm 122.

Referring to FIGS. 6 and 7, and as the cam follower 150 continues to translate downwardly, the lower contacting surface 164 of the engagement portion 154 bears against the extending cylindrical surface of the extending pin 114, overcoming the biasing force of the center spring 110, and pivoting the L-shaped lever 100 and the cutting blade 108 inwardly toward the defined paper travel path. The serrated, light gauge, cutting teeth 112 of the cutting blade 108 therefore enter the paper travel path, cutting the paper 140 as is most clearly shown according to FIG. 7(*a*). The length of travel of the cam follower 150 and the inward rotation of the L-shaped lever 100 is restricted by the engagement of the cylindrical pin 114 of the knife lever 100 with the lower end of the arcuate slot 118.

As the paper 140, FIG. 1, is cut, the applied tension to the feed roller 72 by the user is discontinued. Therefore, the contacting portion 130 of the cam throw arm 122 rotates off the tapered portion 161 of the upper bearing surface 160 of the engagement portion 158, allowing the biasing knife return spring 110 to pull the L-shaped lever 100 into its original position. This movement of the knife lever 100 causes the appending pin 114 to move up the arcuate slot 118 and pushes the cam follower 150 to its original upper position, FIG. 5, ready for the next cycle.

Preferably, a rubberized stop or bumper 180 is fastened or otherwise attached to the side supporting plate 36 and positioned adjacently above the supports 146 so as to prevent the cam follower 150 and the T-shaped engagement portion 158 from exceeding a position above the cam throw arm 122 at the top of its stroke.

In the meantime, the tensioning spring 138 pulls the cam throw arm 122, direction 178, FIG. 7, and causes an approximate ½ revolution of the feed roller 72, FIG. 1, thereby metering a predetermined length of paper towel through the exit slot 88 of the housing 20 and returning the components of the dispensing mechanism 12 to the positions shown in FIGS. 5 and 5(*a*), allowing the above described procedure to be repeated as needed. As should be apparent from the foregoing discussion, the dimensions of the feed roller 72 dictate the size of the paper roll used, as well as the length of towel dispensed.

Alternate configurations can be easily imagined. For example, a second supply roll (not shown) can be attached to a second pair of axial supporting tabs 188, FIG. 1, located immediately behind the feed roller 72. Otherwise, the paper supply roll 68 could also be supplied from a source unattached to the frame 32, which is then similarly directed through the paper travel path of the dispensing mechanism 12. Still further, it should be readily apparent that the frame and several of the components could be injection-molded, or similarly manufactured, allowing the mechanism or portions thereof to be mass-produced, and minimizing the number of threaded fasteners and other components in the described assembly.

It should be readily apparent to those of ordinary skill in the field that modifications and changes can be contemplated by those of ordinary skill in the field which contain the spirit and scope of the invention, according to the appended claims.

I claim:

1. Apparatus for dispensing a predetermined length of paper material, said apparatus comprising:

a frame having an upper portion, said upper portion containing means for retaining a paper supply roll;

a first roller rotatably supported within said frame beneath said supply roll retaining means;

a second roller in engagement with said first roller, said first and second rollers forming a nip through which paper from the retained paper supply roll extends along a paper travel path, said path extending through said nip and through a lower portion of said frame;

a knife assembly attached to the lower portion of said frame beneath said first and second rollers, said knife assembly including at least one cutting blade attached to a lever element, said knife assembly being pivotable between a retracted position and a paper cutting position extending into said paper travel path;

first biasing means attached to said lever element for biasing said knife assembly to said retracted position;

a throw arm attached to one end of said first roller, said arm being rotatably movable along with said first roller and disposed along an exterior side of said frame;

second biasing means for biasing said throw arm and said first roller to an initial rotational position; and a translatably movable cam follower attached to the same exterior side of said frame as said throw arm, said cam follower having a first bearing surface in contact with an engagement end of said lever element of said knife assembly and a second bearing surface for contacting said throw arm over at least a portion of a rotational path taken by said throw arm during rotation of said first roller to allow metered dispensing of said paper material.

2. Apparatus as recited in claim 1, wherein said first roller is a feed roller having a circumference corresponding to a length of paper dispensed.

3. Apparatus as recited in claim 2, wherein said frame includes an arcuate slot receiving the engagement end of said lever element, wherein opposing ends of said arcuate slot represent the retracted and paper cutting positions of said knife assembly.

4. Apparatus as recited in claim 1, including means for supporting and guiding said translatable movable cam follower, said supporting and guiding means including a pair of parallel rails attached to the said exterior side of said frame, said rails having a defined spacing corresponding in size to the width of a linear base section of said cam follower, said rails slidably receiving said linear base section in said spacing for movement of said cam follower in an axial direction.

5. Apparatus as recited in claim 4, wherein the linear base section of said movable cam follower includes a substantially T-shaped cross section, said cam follower further including a transverse section interconnected to said linear base section and arranged along an intermediate length of said linear base section wherein said first and second bearing surfaces are disposed on opposing sides of said transverse section.

6. Apparatus as recited in claim 5, wherein each of said parallel rails includes a recess extending along a major dimension thereof, each of said recesses extending the spacing defined between said rails and receiving a the wider portion of the substantially T-shaped cross section of said linear base section.

7. Apparatus as recited in claim 1, wherein the second bearing surface of said cam follower includes a tapered portion for allowing said throw arm to rotate off said cam follower after said at least one cutting blade has cut the predetermined length of paper material.

8. Apparatus as recited in claim 1, wherein said first biasing means is at least one spring attaching said knife assembly to said frame, said at least one spring being disposed at substantially the midpoint of a major dimension of the lever element.

9. Apparatus as recited in claim 1, wherein said throw arm is radially aligned with a primary rotational axis of said first roller.

10. Apparatus as recited in claim 1, wherein said second biasing means includes a tensioning spring attached to an outer radial portion of said throw arm at one end and to the exterior of said frame at a remaining end.

11. Apparatus as recited in claim 1, including a stop provided on the exterior of said frame in proximity to one end of said cam follower to prevent excessive translational movement of said cam follower.

* * * * *